US008857519B2

(12) United States Patent
Hale

(10) Patent No.: US 8,857,519 B2
(45) Date of Patent: Oct. 14, 2014

(54) METHOD OF RETROFITTING SUBSEA EQUIPMENT WITH SEPARATION AND BOOSTING

(75) Inventor: James Raymond Hale, Katy, TX (US)

(73) Assignee: Shell Oil Company, Houston, TX (US)

( * ) Notice: Subject to any disclaimer, the term of this patent is extended or adjusted under 35 U.S.C. 154(b) by 57 days.

(21) Appl. No.: 13/643,304

(22) PCT Filed: Apr. 25, 2011

(86) PCT No.: PCT/US2011/033731

§ 371 (c)(1),
(2), (4) Date: Oct. 25, 2012

(87) PCT Pub. No.: WO2011/137053

PCT Pub. Date: Nov. 3, 2011

(65) Prior Publication Data

US 2013/0043035 A1 Feb. 21, 2013

Related U.S. Application Data

(60) Provisional application No. 61/328,483, filed on Apr. 27, 2010.

(51) Int. Cl.
*E21B 43/017* (2006.01)
*E21B 43/36* (2006.01)

(52) U.S. Cl.
CPC ..... *E21B 43/36* (2013.01); *E21B 43/017* (2013.01)
USPC ..... 166/338; 166/344; 166/357; 166/366; 166/267

(58) Field of Classification Search
CPC ..... E21B 43/017; E21B 43/36
USPC ..... 166/338, 344, 357, 366, 369, 75.12, 166/267
See application file for complete search history.

(56) References Cited

U.S. PATENT DOCUMENTS

| | | | | |
|---|---|---|---|---|
| 4,527,632 | A * | 7/1985 | Chaudot | 166/357 |
| 4,705,114 | A * | 11/1987 | Schroeder et al. | 166/357 |
| 4,982,794 | A * | 1/1991 | Houot | 166/357 |
| 6,230,810 | B1 * | 5/2001 | Rivas | 166/357 |
| 7,073,593 | B2 * | 7/2006 | Hatton et al. | 166/367 |
| 7,093,661 | B2 * | 8/2006 | Olsen | 166/357 |
| 7,296,629 | B2 * | 11/2007 | Bartlett | 166/348 |
| 7,426,963 | B2 * | 9/2008 | O'Neill | 166/365 |
| 7,770,651 | B2 * | 8/2010 | Krehbiel et al. | 166/357 |

(Continued)

FOREIGN PATENT DOCUMENTS

| | | | |
|---|---|---|---|
| WO | WO2009047521 | 4/2009 | E21B 43/12 |
| WO | WO2010014770 | 2/2010 | E21B 43/12 |

*Primary Examiner* — Matthew Buck

(57) ABSTRACT

A subsea production and separation system comprising a subsea well drilled into a sea floor; a subsea tree located on the sea floor at a top portion of the subsea well; a manifold located on the sea floor; a well jumper connecting the subsea tree and the manifold; a first sled located on the sea floor; a second sled located on the sea floor; a separator located on the sea floor; a first flowline jumper connecting the manifold to the separator; a second flowline jumper connecting the manifold to the separator; a third flowline jumper connecting the separator to the first sled; a fourth flowline jumper connecting the separator to the second sled; a liquid export line connected to the third flowline jumper; and a gas export line connected to the fourth flowline jumper.

14 Claims, 1 Drawing Sheet

(56) References Cited

U.S. PATENT DOCUMENTS

| | | | | |
|---|---|---|---|---|
| 7,793,724 | B2 * | 9/2010 | Daniel et al. | 166/366 |
| 8,220,551 | B2 * | 7/2012 | Fenton | 166/357 |
| 8,607,877 | B2 * | 12/2013 | Rodrigues | 166/344 |
| 2003/0188873 | A1 * | 10/2003 | Anderson et al. | 166/357 |
| 2004/0144543 | A1 * | 7/2004 | Appleford et al. | 166/336 |
| 2005/0145388 | A1 * | 7/2005 | Hopper | 166/357 |
| 2007/0144631 | A1 | 6/2007 | Clavenna et al. | 148/558 |
| 2007/0227740 | A1 * | 10/2007 | Fontenette et al. | 166/344 |
| 2009/0035067 | A1 * | 2/2009 | Wilson et al. | 405/154.1 |
| 2009/0211763 | A1 * | 8/2009 | Fowler et al. | 166/357 |
| 2009/0211764 | A1 * | 8/2009 | Fielding et al. | 166/357 |
| 2011/0132615 | A1 * | 6/2011 | Gonzalez et al. | 166/366 |
| 2011/0155385 | A1 * | 6/2011 | Haheim | 166/357 |
| 2012/0211230 | A1 * | 8/2012 | Anderson et al. | 166/335 |

* cited by examiner

METHOD OF RETROFITTING SUBSEA EQUIPMENT WITH SEPARATION AND BOOSTING

PRIORITY CLAIM

The present application claims priority from PCT/US2011/033731, filed 25 Apr. 2011, which claims priority from US provisional 61/328,483, filed 27 Apr. 2010.

BACKGROUND OF THE INVENTION

Embodiments disclosed herein relate generally to subsea production and separation systems.

BACKGROUND ART

U.S. Publication Number 2009/0211763 discloses a Vertical Annular Separation and Pumping System (VASPS) utilizing an isolation baffle to replace a standard pump shroud associated with an electrical submersible pump. The isolation baffle may be a one piece plate positioned so as to direct produced wellbore liquids around the electrical submersible pump motor to provide a cooling medium to prevent overheating and early failure of the electrical submersible pump. U.S. Publication Number 2009/0211763 is herein incorporated by reference in its entirety.

U.S. Publication Number 2009/0035067 discloses a seafloor pump assembly that is installed within a caisson that has an upper end for receiving a flow of fluid containing gas and liquid. The pump assembly is enclosed within a shroud that has an upper end that seals around the pump assembly and a lower end that is below the motor and is open. An eduction tube has an upper end above the shroud within the upper portion of the caisson and a lower end in fluid communication with an interior portion of the shroud. The eduction tube causes gas that separates from the liquid and collects in the upper portion of the caisson to be drawn into the pump and mixed with the liquid as the liquid is being pumped. U.S. Publication Number 2009/0035067 is herein incorporated by reference in its entirety.

International Publication Number WO 2007/144631 discloses a method of separating a multiphase fluid, the fluid comprising a relatively high density component and a relatively low density component, comprises introducing the fluid into a separation region; imparting a rotational movement into the multiphase fluid; forming an outer annular region of rotating fluid of predetermined thickness within the separation region; and forming and maintaining a core of fluid in an inner region; wherein fluid entering the separation vessel is directed into the outer annular region; and the thickness of the outer annular region is such that the high density component is concentrated and substantially contained within this region, the low density component being concentrated in the rotating core. A separation system employing the method is also disclosed. The method and system are particularly suitable for the separation of solid debris from the fluids produced by a subterranean oil or gas well at wellhead flow pressure. International Publication Number WO 2007/144631 is herein incorporated by reference in its entirety.

International Publication Number WO 2009/047521 discloses equipment and a subsea pumping system using a subsea module installed on the sea bed, preferably away from a production well and intended to pump hydrocarbons having a high associated gas fraction produced by one or more subsea production wells to the surface. A pumping module (PM) is disclosed which is linked to pumping equipment already present in a production well and which basically comprises: an inlet pipe, separator equipment, a first pump and a second pump. In the subsea pumping system for the production of hydrocarbons with a high gas fraction, when oil is pumped from the production well (P) the well pump increases the energy of the fluid in the form of pressure and transmits this increase in energy in the form of an increase in suction pressure in the second pump of the subsea module (PM). International Publication Number WO 2009/047521 is herein incorporated by reference in its entirety.

Co-pending U.S. patent application 61/255,212, filed Oct. 27, 2009, having attorney docket number TH3898 discloses a method for separating a multiphase fluid, the fluid comprising a relatively high density component and a relatively low density component, the method comprising: introducing the fluid into a separation region; imparting a rotational movement into the multiphase fluid; forming an outer annular region of rotating fluid within the separation region; and forming and maintaining a core of fluid in an inner region; wherein fluid entering the separation vessel is directed into the outer annular region; and the thickness of the outer annular region is such that the high density component is concentrated and substantially contained within this region, the low density component being concentrated in the rotating core. U.S. patent application 61/255,212 is herein incorporated by reference in its entirety.

Patent Publication WO 2010/014770 discloses a method and system for subsea processing multiphase well effluents comprising natural gas and liquid from a subsea hydrocarbon containing formation, including a fluid separation vessel which is connected to a downstream end of a multiphase well effluent transportation conduit; a liquid level transmitter assembly for monitoring the gas liquid interface in the fluid separation vessel; a liquid enriched fluid transportation flowline connected at or near the bottom of the fluid separation vessel and a gas enriched fluid transportation flowline connected at or near a top of the fluid separation vessel; a pump connected to an electric motor; and a fast acting variable speed drive system, which is coupled to the liquid level controller which adjusts the pump and motor speed setpoint within 2 seconds to maintain the liquid level in the vessel at a predetermined setpoint. Patent Publication WO 2010/014770 is herein incorporated by reference in its entirety.

Accordingly, there is a continuing need for subsea separation and production systems. There is a further need in the art for modifying existing subsea production systems by adding separation and optionally pumping facilities.

SUMMARY OF THE DISCLOSURE

In one aspect, embodiments disclosed herein relate to subsea separation systems.

One aspect of the invention provides a subsea production and separation system comprising a subsea well drilled into a sea floor; a subsea tree located on the sea floor at a top portion of the subsea well; a manifold located on the sea floor; a well jumper connecting the subsea tree and the manifold; a first sled located on the sea floor; a second sled located on the sea floor; a separator located on the sea floor; a first flowline jumper connecting the manifold to the separator; a second flowline jumper connecting the manifold to the separator; a third flowline jumper connecting the separator to the first sled; a fourth flowline jumper connecting the separator to the second sled; a liquid export line connected to the third flowline jumper; and a gas export line connected to the fourth flowline jumper.

Another aspect of the invention provides a method of retrofitting a subsea production system, wherein the system includes a subsea well drilled into a sea floor; a subsea tree located on the sea floor at a top portion of the subsea well; a manifold located on the sea floor; a well jumper connecting the subsea tree and the manifold; a first sled located on the sea floor; a second sled located on the sea floor; a first flowline jumper connecting the manifold to the first sled; a second flowline jumper connecting the manifold to the second sled; a liquid export line connected to the flowline jumper at the first sled; and a gas export line connected to the flowline jumper at the second sled; the method comprising: disconnecting the first flowline jumper from the first sled; disconnecting the second flowline jumper from the second sled; installing a separator on the sea floor; connecting the first flowline jumper to the separator; connecting the second flowline jumper to the separator; connecting a third flowline jumper from the separator to the first sled; and connecting a fourth flowline jumper from the separator to the second sled.

Other aspects and advantages of the invention will be apparent from the following description and the appended claims.

DETAILED DESCRIPTION

In one aspect, embodiments disclosed herein relate generally to apparatuses and methods for installing and retrofitting equipment for the production of hydrocarbons. More specifically, embodiments disclosed herein relate to apparatuses and methods for retrofitting existing multi-flowline, subsea tie-backs with subsea separation and pumping equipment. More specifically still, embodiments disclosed herein relate to apparatuses and methods for retrofitting existing multi-flowline, subsea tie-backs with a separator and installing electric submersible pumps in the flowlines for the production of hydrocarbons such that boosted oil flows through one line and gas through another.

Figure 1:
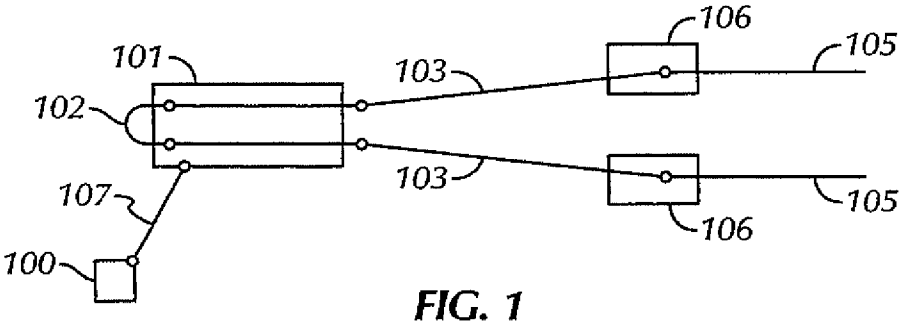
FIG. 1 is a schematic illustration of a subsea layout prior to retrofitting according to embodiments of the present disclosure.

FIG. 1:

Referring initially to FIG. 1, a schematic illustration of a subsea layout prior to retrofitting, is shown. In this embodiment, a subsea tree 100 and well jumper 107 is in fluid communication with a wellhead (not shown). Subsea tree 100 includes an assembly of valves, pressure gages, chokes, and the like, which is attached to a completed well, and is used to control the flow of fluids therefrom during production operations. Those of ordinary skill in the art will appreciate that subsea tree 100 may be of various configurations and include the ability to operate in various functionalities, such as, for example, high pressure systems, low pressure systems, as well as single or multiple capacity systems.

As illustrated, subsea tree 100 is in fluid communication with a subsea manifold 101. Subsea manifold 101 is configured to receive a flow of fluids from subsea tree 100, and allow the fluids to be controlled, monitored, and distributed to downstream processing equipment. Subsea manifold 101 may include piping arrangements, as well as one or more chokes, valves, and/or pressure sensors, such that the flow of fluids from subsea tree 100 may be controlled and monitored. In certain embodiments, subsea manifold 101 may be configured to receive a flow of fluids from multiple wells, and as such, subsea manifold 101 may be in fluid communication with multiple subsea trees 100. For example, in particular production operations, a single subsea manifold 101 may be configured to receive a flow of fluids from four to ten wells, and in the subsea manifold 101, depending on the nature of the production operation, the fluids may be allowed to comingle, or may otherwise be retained in discrete streams. In addition to connecting and centralizing the flow of produced fluids from multiple wells, subsea manifold 101 may be configured with a pigging loop 102, thereby allowing the piping in the subsea manifold to be maintained and cleaned.

Subsea manifold 101 is also in fluid communication with one or more flowline jumpers 103. Flowline jumpers 103 include piping or conduits that may run along the seabed, and are configured to allow fluids from subsea manifold 101 to be transferred to one or more sleds 106 through flowlines 105 to production processing facilities (not shown). Sleds 106 may include single or multiple flowline end capabilities, as well as allow connections from various types of vessels and production structures, such as platforms. Sleds 106 may also include manual isolation valves or actuated valves, and may allow for chemical injection, artificial gas lift, and pig launching capabilities.

During typical operation, as hydrocarbons are produced from a well (not shown), the hydrocarbons flow through subsea tree 100, through a short jumper flowline 107 and into subsea manifold 101. In subsea manifold 101, the hydrocarbons may comingle with fluids produced from other wells in the area, and may be monitored to determine pressures, temperatures, etc. The hydrocarbons are then routed through flowline jumpers 103 to sleds 106, wherein the hydrocarbons may be routed to other flowlines 105 and then routed to a production facility, such as a host platform (not shown). As illustrated, such a design may have two flowline jumpers 103 that connect through two discrete sleds 106 into two discrete flowlines 105; however, those of ordinary skill in the art will appreciate that in2 other embodiments, more or less than two flowline jumpers 103, sleds 106, and flowlines 105 may be used.

Figure 2:
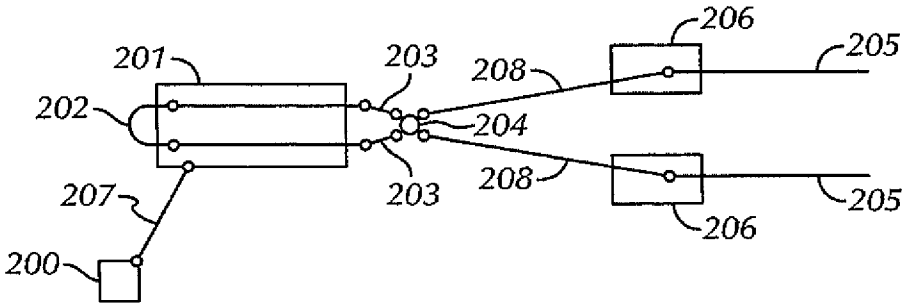
FIG. 2 is a schematic illustration of a subsea layout according to embodiments of the present disclosure.

FIG. 2:

Referring to FIG. 2, a schematic illustration of a subsea layout after retrofitting with separation equipment in accordance with embodiments of the present disclosure is shown. In this embodiment, a subsea tree 200 is illustrated in fluid communication with a wellhead (not shown) and a subsea manifold 201. Fluid communication is provided between subsea tree 200 and subsea manifold 201 via a short well jumper 207. As explained above, subsea manifold 201 may be configured to receive a flow of produced fluids from multiple wells and may include a pigging loop 202, thereby allowing conduits and piping of subsea manifold 201 to be maintained and cleaned.

Subsea manifold 201 is also in fluid communication with flowline jumpers 203, thereby allowing fluids to be transferred to a separator 204. Separator 204 is configured to receive produced fluids from subsea manifold 201, and separate the fluids into a substantially gas phase and a substantially liquid phase. In certain embodiments, separator 204 may include a vertical separator vessel disposed in a suction pile, which is described in detail below. However, those of ordinary skill in the art will appreciate that separator 204 may also include other types of separators capable of separating a fluid into a gas phase and a liquid phase.

After the gas and liquid phases are separated, the discrete fluid streams are transferred by independent flowline jumpers 208 to sleds 206. Sleds 206 may then route the discrete gas and liquid phases to production platforms or other equipment for additional processing and/or storage. While sleds 206 in FIG. 2 are illustrated as either receiving a discrete gas phase or liquid phase, in certain embodiments, a single sled 206 may be configured to receive both gas feeds and liquid feeds. Similarly, in certain embodiments, sleds 206 may be configured to receive multiple gas or liquid feeds from multiple separators connected to other subsea manifolds 101 and wells in the area.

To facilitate the transfer of hydrocarbons through separator 204, a pump (not shown) may be disposed in one or more of flowline jumpers 208. In one embodiment, the pump may be an electric submersible pump (ESP) that is disposed in flowline jumpers 208, while in other embodiments, the pump may be disposed in a riser (not shown) or flowline 205. In an embodiment where the pump is disposed in a riser, the top of the riser may be configured to have vertical access for a coiled-tubing or wireline unit, as well as be configured with a dry-tree assembly with electric penetrations for the pump wiring.

To power the pump, a topside control unit may be installed on a host (not shown), such as a platform or production vessel. Power from the host may be routed from generators on the host to the pump via the electric connections on the dry tree or subsea wet mateable connectors, or in certain embodiments, separate power generators dedicated to power the pump may be installed. In certain embodiments, an adjustable speed drive, such as a variable frequency drive (VFD) may also be provided in operative communication with the pump. The VFD may then be used to stop and/or start the pump, allowing for both pump speed control, as well as allowing for the voltage and current to be continuously monitored. Such monitoring may facilitate fluid level control in the separator 204, which is described in detail below.

Figure 3:
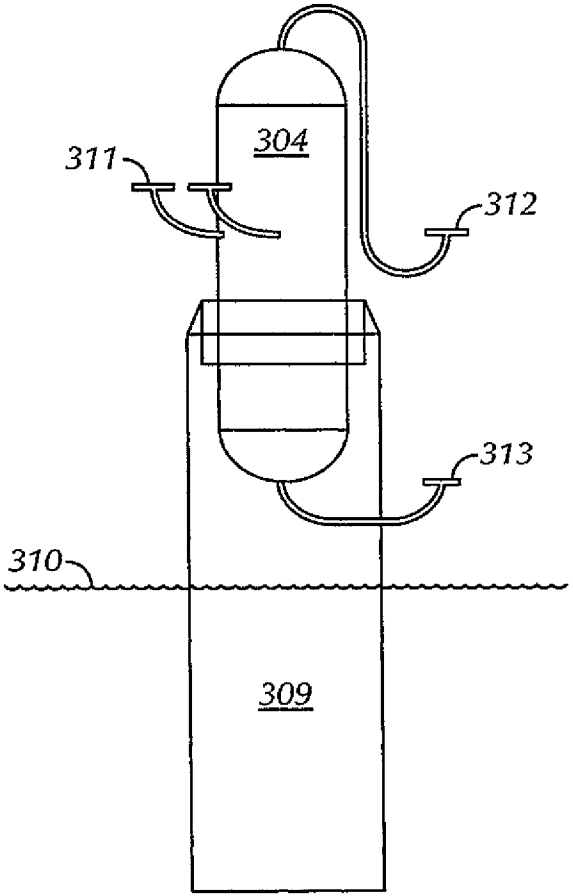
FIG. 3 is a side view of a subsea separator according to embodiments of the present disclosure.

FIG. 3:

Referring to FIG. 3, a side view of a separator 304 according to embodiments of the present disclosure is shown. In this embodiment, separator 304 is a vertical separator and is illustrated disposed in a suction pile 309, which is disposed on the seafloor or buried in a hole on the seafloor. As illustrated, suction pile 309 is embedded in the seafloor up to mudline 310, thereby allowing suction pile 309 to remain in place during production operations. During operation, fluids are transferred from the subsea manifold (not shown) to separator 304 via inlets 311. As hydrocarbon fluids enter separator 304, the liquid phase of the fluids tends to settle to the bottom of separator 304, while the gas phase of the fluids tends to rise to the top of separator 304 via gravity separation. The gas phase is then allowed to freely exit separator 304 via gas outlet 312 into jumper flowlines (not shown) in fluid communication with sleds (not shown) or a host (not shown). Similarly, the liquid phase is allowed to flow freely out of the separator via liquid outlets 313 into flowline jumpers, where the liquid phase may be pumped to the surface using a pump, as described above. Although separator 304 is shown only at a top portion of suction pile 309, in other embodiments, separator 304 may also be partially or completely buried beneath mudline, and/or separator 304 may extend for the length of suction pile 309

In one embodiment, a pump may be disposed at the base of separator 304 to provide a pressure boost to the liquid portion in the base, with the pump outlet connected to liquid outlets 313. One suitable pump is an electrical submersible pump (ESP) located in the base of suction pile 309 or separator 304.

In another embodiment, rather than use gravity separation alone, a gas-liquid cylindrical cyclone (GLCC) separator may be used. In a GLCC separator, the fluid enters the separator though an inlet via a tangential nozzle. The momentum of the feed of the fluid into the separator, combined with the nozzle, generates a vortex allowing the gas phase to separate from the liquid phase more rapidly than during gravity separation. Similar to separator 304, in a GLCC, after the initial separation, the gas phase may freely exit the separator through a top portion of the separator vessel, while the liquid phase may freely exit the separator through a bottom portion of the separator vessel. Those of ordinary skill in the art will appreciate that a nozzle of the GLCC separator may be adjusted to achieve a particular type of flow into the separator, as well as the momentum of the flow may be adjusted to enhance or inhibit the separation of the produced fluid. Those of ordinary skill in the art will appreciate that in other embodiments other types of separators using separation based on, for example, gravity or centrifugal forces, may be used to separate the liquid phase from the gas phase.

In one embodiment, a GLCC is used in series with separator 304. GLCC performs a first gas-liquid separation step, then separator 304 does a further separation of either the gas or the liquid feed from the GLCC.

Installation:

During the retrofitting of an existing subsea production layout with the separator, as described above, a number of steps may be performed. During subsea installation and retrofitting of a subsea production layout, the existing flowline jumpers from the manifold to the sleds are removed. The separator may then be installed between the subsea manifold and the sleds, where the separator is disposed in relatively close proximity to the subsea manifold. After the separator is disposed in place, new flowline jumpers may be installed between the subsea manifold and the separator and between the separator and the sled and/or flowlines. In one embodiment, installation of the separator may include disposing a suction pile on the seafloor and incorporating a vertical separator into the suction pile. One method of incorporating a vertical separator into a suction pile may include fabricating a suction pile to include the vertical separator as an integral component, and then lowering the suction pile with separator onto the seafloor from an anchor handler vessel. In such an embodiment, no additional subsea controls are necessary, however, in certain embodiments, additional sensors for measuring pressure, temperature, etc., may also be installed during the subsea installation operation.

In addition to subsea installation, the retrofitting operation may include installation of a pump, such as an ESP, as described above. Pump installation may include running an ESP into a flowline or riser using existing coiled-tubing or wireline from a host, such as a platform. In certain embodiments the ESP may be located in the riser section or along a flowline and may be deployed using coiled tubing or the like. Pump installation may further include making up electrical connections between the ESP and the host, or otherwise providing electrical connections to new power sources disposed on a host, as described above. Depending on the specific retrofitting operation, the pump may be installed at various locations within the riser or flowline, and in operations where there exist multiple liquid outlets from the separator, multiple pumps may be installed. Those of ordinary skill in the art will appreciate that to achieve the highest production rate, a pump or a compressor may be required for each flowline and/or flowline jumper configured to remove gas and/or liquids from the separator.

The retrofitting operation may also include a topside installation, whereby components are installed on the host. During topside installation, pump power supply modules and controls may be installed on the host. In certain embodiments, topside installation may include connecting the pump to generators that are already associated with the host, while in other embodiments, topside installation may include installing new generators and connecting the new generators to the pump. Other components that may be installed on the host include an adjustable speed drive, such as a VFD, as described above. Certain embodiments may further require the installation of topside control modules, such as programmable logic controllers, to allow for fluid levels in the separator to be monitored and adjusted. However, in other embodiments, the control of the pump through a VFD may allow for the levels of fluid in the separator to be monitored and adjusted without the need for additional control components.

In an embodiment where a VFD is operatively connected to an ESP the liquid level in separator 304 nay be measured, or alternatively, the operation of the ESP may inform an operator as to the liquid level in the separator. For example, if the gas flowline begins to extract liquid from the separator, and thus begins slugging, the operator will know that the separator has too high a ratio of liquids. In such a condition, the speed of the ESP may be increased, or the flow of fluids into the separator decreased. Additionally, the liquids may be displaced back into the separator by injecting gas from the host into the flowline.

Alternatively, if gas begins to be produced from the liquid line, the ESP amperage draw may become erratic, thereby indicating that the liquid level in the separator is low. In order to increase the liquid level in the separator, a choke restriction may be reduced, thereby increasing the flow of fluids into the separator. Additionally, the ESP speed may be reduced, thereby decreasing the draw on the separator, allowing a greater volume of liquids to settle out in the separator.

Using such methods, an operator may be able to determine the level of liquids in the separator, thereby using the operational conditions of an ESP to determine the state of the separator. In embodiments where the ESP is connected to a VFD, the speed of the ESP may be continuously adjusted, thereby allowing the fluid level in the separator to be quickly adjusted in response to gas entering a liquid flowline or liquids entering a gas flowline. In certain embodiments, a speed adjustment of the ESP may be substantially automated by measuring liquid level in a separator and setting high and low level limits. During operation, ESP speed is continuously adjusted to maintain liquid level; if a high level limit is reached, thereby indicating that a fluid level in the separator is too high, the speed of the ESP could be increased, thereby decreasing the liquid level in the separator and preventing liquid phase from entering the gas flowlines. Similarly, if a low level limit is reached, thereby indicating that a fluid level in the separator is too low, the speed of the ESP could be decreased, thereby increasing the liquid level in the separator.

In certain automated systems, in addition to controlling the speed of the ESP based on liquid levels within the separator, choke adjustment may also be controlled. For example, in an embodiment wherein the liquid level in a separator is too high, and the ESP speed cannot be sufficiently increased to overcome the high liquid level, a choke may be adjusted to restrict flow of fluids into the separator. Similarly, in an embodiment wherein the liquid level in a separator is too low, and the ESP speed cannot be sufficiently decreased to overcome the low liquid level, the ESP could be entirely shut down for a period of time, or alternatively, a choke may be adjusted to increase the flow of fluids into the separator.

During certain operations, such as when liquid phase enters a gas flowline, the gas flowline may require cleaning prior to continuing use of the flow line. In order to clean the gas flowline, a pig may be run through the gas flowline. During such an operation, the pig may be introduced to the gas flowline from an associated sled. As the liquid and gas flowlines are discrete, the cleaning operation may be optimized such that only the gas flowline may require cleaning.

Advantageously, embodiments of the present disclosure may provide methods of retrofitting existing subsea production layouts with liquid/gas phase separators to increase the efficiency of the production operation and reduce reservoir back pressure; allowing higher production rates and recovery of more hydrocarbons. The retrofitting operation may be advantageous to installing entirely new infrastructure, as the use of VFD controlled ESPs in the flowlines and risers may prevent the requirement of additional control systems. As the subsea controls may not require changes, the retrofitting operation may be relatively quick and relatively inexpensive, thereby decreasing the net cost of the retrofitting, and thus the production operation.

Also advantageously, the apparatus of the present disclosure may provide inexpensive solutions allowing for the separation of production fluids. The separation apparatus may be relatively inexpensive and relatively easy to fabricate, advantageously relying on suction piles and separator vessels. Also advantageously, the overall layout may not require significant adjustment, as flowline jumpers may be removed and installed relatively quickly, thereby preventing production downtime.

Advantageously, the modularity of the system may also allow for modification of the system in response to changing production conditions. For example, as the system and methods described herein use pumps, such as an ESP that may be disposed in various sections of the production operation, the pumps may be moved depending on production conditions. In certain operations, the ESP may be installed in flowlines, while in other operations, the ESP may be installed in a flowline jumper or riser. Also advantageously, the ESP may be disposed through coiled-tubing or via wireline, which are readily available at production hosts.

Illustrative Embodiments:

In one embodiment, there is disclosed a subsea production and separation system comprising a subsea well drilled into a sea floor; a subsea tree located on the sea floor at a top portion of the subsea well; a manifold located on the sea floor; a well jumper connecting the subsea tree and the manifold; a first sled located on the sea floor; a second sled located on the sea floor; a separator located on the sea floor; a first flowline jumper connecting the manifold to the separator; a second flowline jumper connecting the manifold to the separator; a third flowline jumper connecting the separator to the first sled; a fourth flowline jumper connecting the separator to the second sled; a liquid export line connected to the third flowline jumper; and a gas export line connected to the fourth flowline jumper. In some embodiments, the system also includes a pigging loop connected to the first flowline jumper and the second flowline jumper at the manifold. In some embodiments, the system also includes a pump located in at least one of the third flowline jumper and the liquid export line. In some embodiments, the system also includes a variable choke in the gas export line. In some embodiments, the system also includes a pump controller connected to the pump. In some embodiments, the system also includes one or more additional subsea wells drilled into the sea floor, and one or more additional subsea trees connected to the one or more additional wells and the manifold. In some embodiments, the system also includes the third flowline jumper is connected to a bottom portion of the separator. In some embodiments, the fourth flowline jumper is connected to a top portion of the separator. In some embodiments, the system also includes a caisson drilled into the sea floor, the separator located within the caisson. In some embodiments, the system also includes a pump within the caisson, the pump connected to the third flowline jumper and the separator.

In one embodiment, there is disclosed a method of retrofitting a subsea production system, wherein the system includes a subsea well drilled into a sea floor; a subsea tree located on the sea floor at a top portion of the subsea well; a manifold located on the sea floor; a well jumper connecting the subsea tree and the manifold; a first sled located on the sea floor; a second sled located on the sea floor; a first flowline jumper connecting the manifold to the first sled; a second flowline jumper connecting the manifold to the second sled; a liquid export line connected to the flowline jumper at the first sled; and a gas export line connected to the flowline jumper at the second sled; the method comprising: disconnecting the first flowline jumper from the first sled; disconnecting the second flowline jumper from the second sled; installing a separator on the sea floor; connecting the first flowline jumper to the separator; connecting the second flowline jumper to the separator; connecting a third flowline jumper from the separator to the first sled; and connecting a fourth flowline jumper from the separator to the second sled. In some embodiments, the method also includes connecting a liquid export line to the third flowline jumper. In some embodiments, the method also includes connecting a gas export line to the fourth flowline jumper. In some embodiments, the method also includes installing a pump at the seafloor and connecting the pump to the third flowline jumper.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A subsea production and separation system comprising:
- a subsea well drilled into a sea floor;
- a subsea tree located on the sea floor at a top portion of the subsea well;
- a manifold located on the sea floor;
- a well jumper connecting the subsea tree and the manifold;
- a first sled located on the sea floor;
- a second sled located on the sea floor;
- a separator located on the sea floor;
- a first flowline jumper connecting the manifold to the separator;
- a second flowline jumper connecting the manifold to the separator;
- a third flowline jumper connecting the separator to the first sled;
- a fourth flowline jumper connecting the separator to the second sled;
- a liquid export line connected to the third flowline jumper; and
- a gas export line connected to the fourth flowline jumper.

2. The system of claim 1, further comprising a pigging loop connected to the first flowline jumper and the second flowline jumper at the manifold.

3. The system of claim 1, further comprising a pump located in at least one of the third flowline jumper and the liquid export line.

4. The system of claim 1, further comprising a variable choke in the gas export line.

5. The system of claim 3, further comprising a pump controller connected to the pump.

6. The system of claim 1, further comprising one or more additional subsea wells drilled into the sea floor, and one or more additional subsea trees connected to the one or more additional wells and the manifold.

7. The system of claim 1, wherein the third flowline jumper is connected to a bottom portion of the separator.

8. The system of claim 1, wherein the fourth flowline jumper is connected to a top portion of the separator.

9. The system of claim 1, further comprising a caisson drilled into the sea floor, the separator located within the caisson.

10. The system of claim 9, further comprising a pump within the caisson, the pump connected to the third flowline jumper and the separator.

11. A method of retrofitting a subsea production system comprising:
- providing a subsea production system, the subsea production system comprising:
  - a subsea well drilled into a sea floor;
  - a subsea tree located on the sea floor at a top portion of the subsea well;
  - a manifold located on the sea floor;
  - a well jumper connecting the subsea tree and the manifold;
  - a first sled located on the sea floor;
  - a second sled located on the sea floor;
  - a first flowline jumper connecting the manifold to the first sled;
  - a second flowline jumper connecting the manifold to the second sled;
  - a liquid export line connected to the first flowline jumper at the first sled; and
  - a gas export line connected to the second flowline jumper at the second sled;
- disconnecting the first flowline jumper from the first sled;
- disconnecting the second flowline jumper from the second sled;
- installing a separator on the sea floor;
- connected the first flowline jumper to the separator;
- connecting the second flowline jumper to the separator;
- connecting a third flowline jumper from the separator to the first sled; and
- connecting a fourth flowline jumper from the separator to the second sled.

12. The method of claim 11, further comprising connecting the liquid export line to the third flowline jumper.

13. The method of claim 11, further comprising connecting the gas export line to the fourth flowline jumper.

14. The method of claim 11, further comprising installing a pump at the seafloor and connecting the pump to the third flowline jumper.

* * * * *